455-613 AU 233 EX

FIP8106 XR 4,150,824

2X X5010B X5005D (4)

United States Patent

Villa 4,150,824

Apr. 24, 1979

[54] OPTOELECTRONIC COMMUNICATIONS SYSTEM

[75] Inventor: Alvaro J. Villa, Northridge, Calif.

[73] Assignee: Walt Disney Productions, Burbank, Calif.

[21] Appl. No.: 718,369

[22] Filed: Aug. 27, 1976

[51] Int. Cl.[2] ..... F41G 7/00

[52] U.S. Cl. ..... 273/101.1; 250/199; 273/102.2 B; 353/113

[58] Field of Search ..... 350/25; 273/101.1, 102.2 B; 250/199; 358/104, 113; 340/337; 307/96, 132; 329/122, 124; 331/25

[56] References Cited

U.S. PATENT DOCUMENTS

| | | | |
|---|---|---|---|
| 2,181,948 | 12/1939 | McClellan | 273/101.1 |
| 2,629,598 | 2/1953 | Hooker | 273/101.1 |
| 3,588,108 | 6/1971 | Ormiston | 273/101.1 |
| 3,811,204 | 5/1974 | Marshall | 273/101.1 |
| 3,956,704 | 5/1976 | Keeney, Jr. et al. | 307/260 |
| 3,956,710 | 5/1976 | Seitz et al. | 307/233 R |

*Primary Examiner*—Robert L. Griffin
*Assistant Examiner*—Edward L. Coles
*Attorney, Agent, or Firm*—Fulwider, Patton, Rieber, Lee & Utecht

[57] ABSTRACT

An optoelectronic communications system in which the transmitter has controlled pulse train duration, pulse rate and pulse width, and a receiver which is sensitive to the pulse rate of the transmitter. The transmitter is incorporated into a firearm replica for a shooting gallery and the receiver is a target displaying a visible light source which is extinguished for a predetermined time period when energy from the transmitter strikes the target.

6 Claims, 6 Drawing Figures

FIG. 2
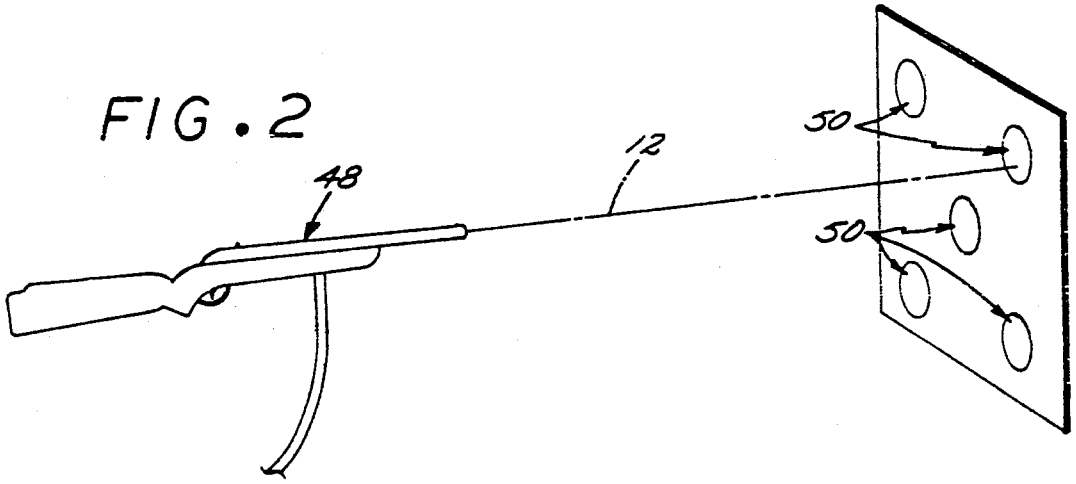
FIG. 3
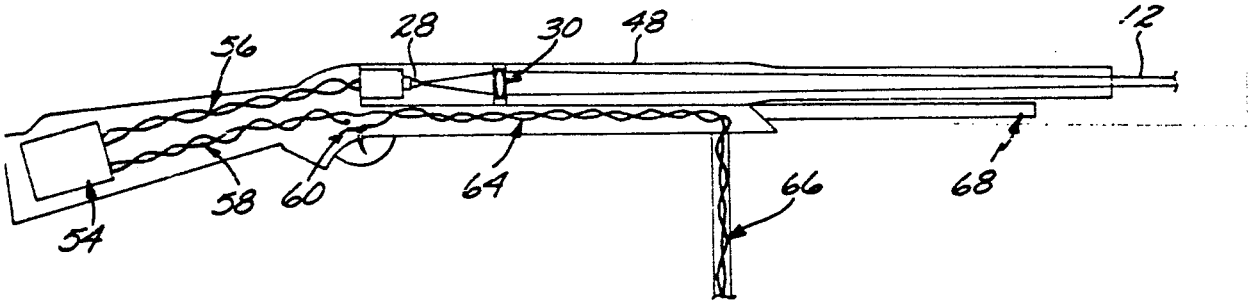
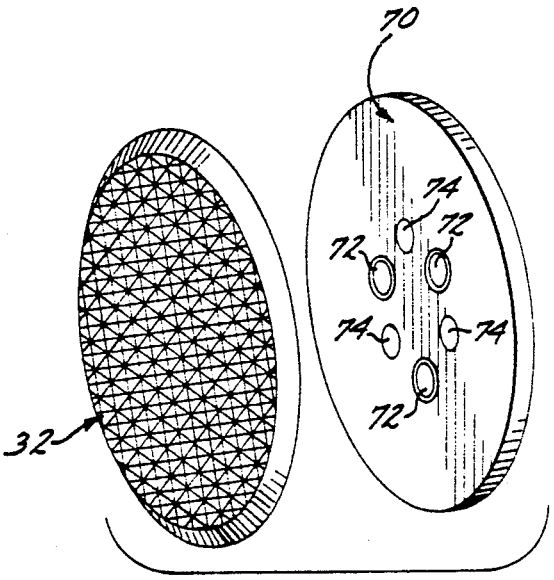
FIG. 4

OPTOELECTRONIC COMMUNICATIONS SYSTEM

BACKGROUND OF THE INVENTION

1. Field of the Invention

The present invention pertains to communications systems in the optical spectrum, and more particularly to such a system having characteristics useful in amusement park shooting gallery applications using light guns.

2. Description of the Prior Art

Many prior art optical communications systems are responsive to continuous light and the receivers in such systems are subject to being triggered by spurious or random light. Other systems which use pulsed light in the visible spectrum have disadvantages for certain applications when it is not desirable to see the transmitted light.

For particular applications, such as the use of a light gun for amusement park shooting galleries, such prior art systems have further disadvantages in that a continuously generated light beam, pulsed or not, permits the shooter to hunt around the target with the beam on until the target is hit.

Thus, for particular applications, such as light guns for shooting galleries, there has long been a need for a system which permitted the transmitting gun to emit optical energy for only a brief period of time when the trigger was pulled and a receiving target which would not be responsive to spurious light. The present invention satisfies that need.

SUMMARY OF THE INVENTION

The optoelectronic communications system of the present invention provides a transmitter which permits the emission of energy in the optical spectrum including the infrared, visible and ultraviolet ranges only in a very controlled manner which has advantages in light gun applications for shooting galleries. The receiver of the system also responds only to the type of signal emitted by the transmitter and has the further advantage or providing a visible indication of when the target is hit by the light beam.

In the presently preferred embodiment of the invention, the pulse train duration, the pulse rate and pulse width of an infrared light beam is controlled and activated by pulling the trigger of a replica of the firearm. The receiving target continuously displays a visible light source which is extinguished for a predetermined time period when struck by infrared energy from the transmitter. Thus, the optoelectronic communications system of the present invention has particular advantage in at least one application, a light gun for use in an amusement park shooting gallery; but the system of the invention could be used to advantage in other applications.

BRIEF DESCRIPTION OF THE DRAWINGS

FIG. 2 is a pictorial view of an illustrative embodiment of the system;

FIG. 3 is a diagrammatic view of a firearm replica illustrating the incorporation of the invention;

FIG. 4 is an exploded perspective view of a portion of the receiver of the system;

DESCRIPTION OF THE PREFERRED EMBODIMENT

Figure 1:
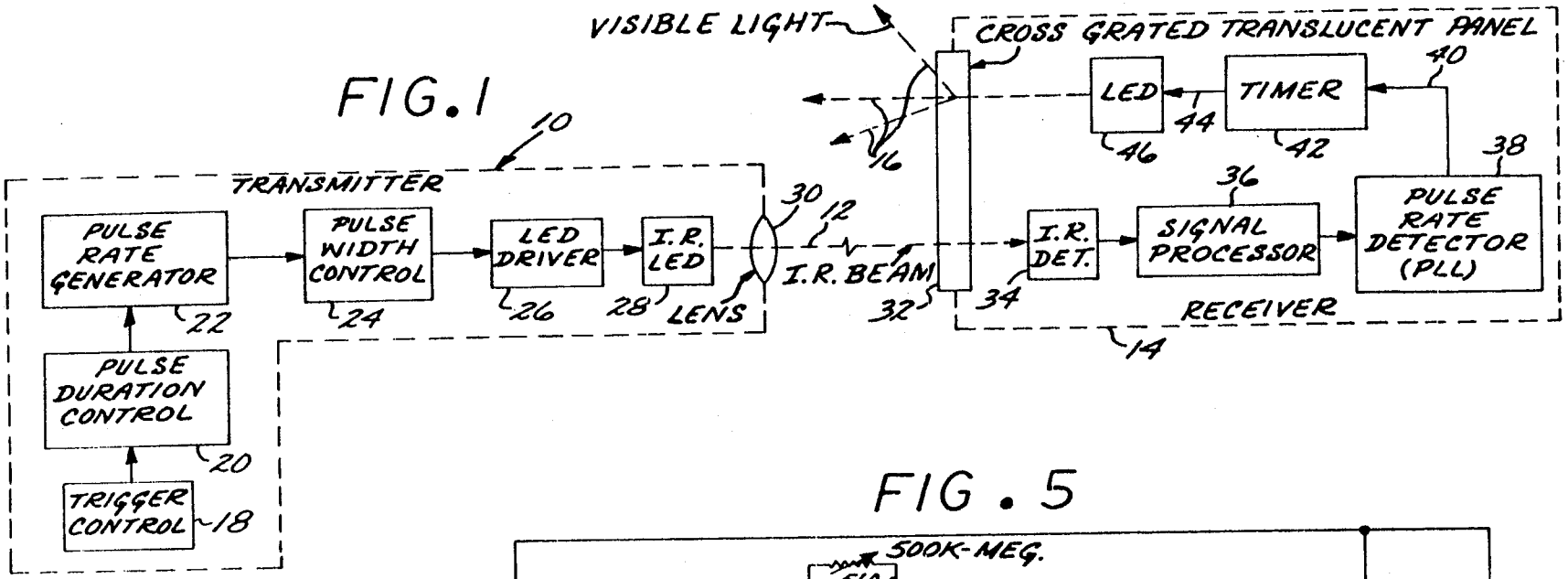
FIG. 1 is a diagrammatic and block diagram representation of the optical communications system of the present invention.

Turning now to the drawings, and particularly FIG. 1 thereof, the system of the invention is illustrated by means of a diagrammatic view. A transmitter 10 generates an infrared beam, such as that illustrated by the phantom line 12, which is aimed at a receiving target 14. The receiver continuously emits visible light such as illustrated by the lines 16, and when the infrared beam strikes the target 14, that visible light is extinguished for a predetermined time period to indicate that the target has been hit.

The emitter infrared beam 12 has characteristics which are particularly advantageous for the illustrated application. Thus, a trigger control 18 enables a pulse train duration control 20 which activates a pulse rate generator 22 for a particular time period which, in the illustrated application, is relatively short to simulate the firing of a gun. The pulse rate generator supplies pulses to a pulse width control 24 which generates relatively short pulses which are applied to a light-emitting diode driver 26 which powers the infrared light-emitting diode 28. The pulse supplied to the infrared light-emitting diode 28 are made relatively short in order to generate an infrared pulse of relatively high power without exceeding the ratings of the diode.

The diode 28 utilized in the illustrated application generates substantially a point source of light which is applied to a lens 30 which focuses the infrared energy from the diode into a narrow beam 12. The narrow infrared beam 12 passes through a translucent panel 32 which has a crossed grating thereon to diffuse the emitted visible light on beam 16. The infrared beam 12 is detected by an infrared detector 34 which supplies a signal to a signal processor 36, which is primarily an amplifier, which in turn supplies an amplified signal to a pulse rate detector 38 which is in the form of a phase-locked loop. If the pulse rate received by the infrared detector is proper, a signal is generated on a line 40 which activates a timer 42 which generates an inhibiting signal for a preset time period on a line 44 which is applied to the light-emitting diodes 46 which generate the visible light 16.

FIG. 2 illustrates the application to which the optical communications system of the invention has been utilized. In particular, a replica of a firearm 48 may be aimed at a plurality of targets 50 in the form of the translucent panels 32 described above.

The incorporation of the transmitting portion of the invention into the firearm replica 48 is illustrated in FIG. 3. The infrared light-emitting diode, which is substantially a point source of light, is mounted within the replica approximately where the conventional breach would be. Since the diode 28 is substantially a point source of light, that light can be focused into a substantially narrow beam by a single achromatic lens 30. The power supply 54 for the diode 28 is mounted within the stock of the replica 48, with the power supply being connected to the diode through a power line 56. The power supply 54 itself is supplied with power through a line 58 which is controlled by a switch 60 which is activated by the trigger 62. The power line 64 supplying the switch 60 is connected to the firearm replica 48 through an air line 66. When the trigger 62 and switch 60 are closed, power is supplied to the power supply 54 and also closes the circuit on a solenoid (not shown) which operates an air valve which permits a burst of air to be connected through the tube 66 and eventually exit out of an orifice 68 which not only produces a realistic noise, but simultaneously produces the typical "kicking" reaction of a firearm to simulate reality.

In order for the receiving target units to both generate visible light and receive infrared radiation, a construction shown in FIG. 4 is utilized in which a receiver circuit board 70 has arrayed on its face alternate light-emitting diodes 72 and infrared detectors 74. The circuit board 70 is placed behind the translucent panel 32 which is provided with crossed gratings to diffuse the light generated by the light-emitting diodes 72 to provide even lumination of the panel. The incoming infrared radiation is also slightly diffused so that it may be received by the infrared detectors 74.

Figure 5:
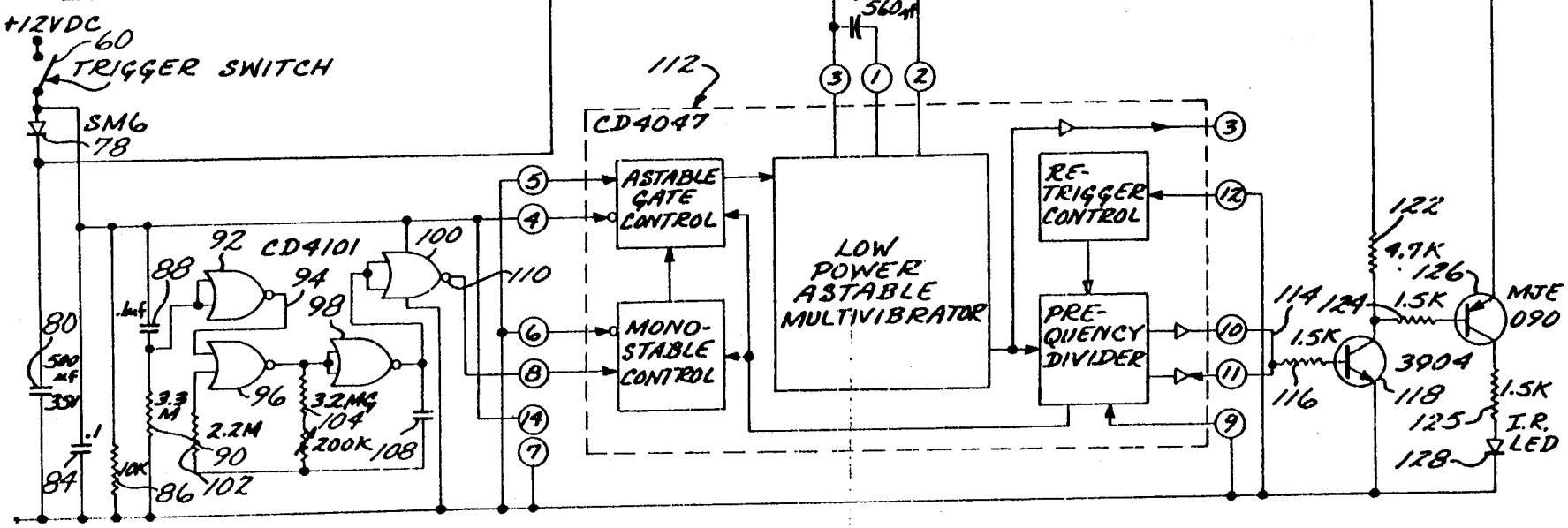
FIG. 5 is an electrical schematic diagram of the controlled power supply for the infrared light source.

An electrical schematic diagram of the infrared power supply is shown in FIG. 5. The closing of the trigger switch 60 applies 12-volts D.C. to the circuit. The 12-volts is connected through line 76 to the timing circuits and connected through a decoupling diode 78 to a large filter capacitor 80 which supplies filtered 12-volts on a line 82 to the diode driver to be described below. When the 12-volts D.C. is connected through line 76 to the timing circuits, a pulse train duration circuit, which includes capacitor 84, resistor 86 and the series circuit of capacitor 88 and resistor 90, the junction of which serve as an input to both input terminals of a NOR gate 92. The charging of the discharged capacitor initially activates a signal on line 94 which enables an 1800 Hz oscillator which includes the three NOR gates 96, 98 and 100, and their associated resistors and capacitor 102-108.

The output of the oscillator on line 110 is a substantially symmetrical square wave which is connected as an input to a conventional and commercially available mono-stable multivibrator 112, the timing circuit of which is selected to produce at its output on line 114 a substantially narrow pulse train. The narrow pulse train is connected as an input through resistor 116 to the input of the diode driver which includes transistors 118 and 120 and associated biasing resistors 122, 124 and 126, which is in turn connected to the infrared light-emitting diode 128.

It should be appreciated that when the capacitor 88 in the pulse train duration circuit has charged to a predetermined value, the state of the NOR gate 92 will change and the oscillator circuit will be inhibited. It has been found that a pulse train duration of approximately 200 milliseconds supplies adequate energy for activating the receiving circuits to be described below. Thus, the transmitting light-emitting diode is on for a relatively short time period and it should also be noted that in order to generate another burst of infrared energy, the trigger switch 60 must be released so that the capacitor 88 can discharge.

Figure 6:
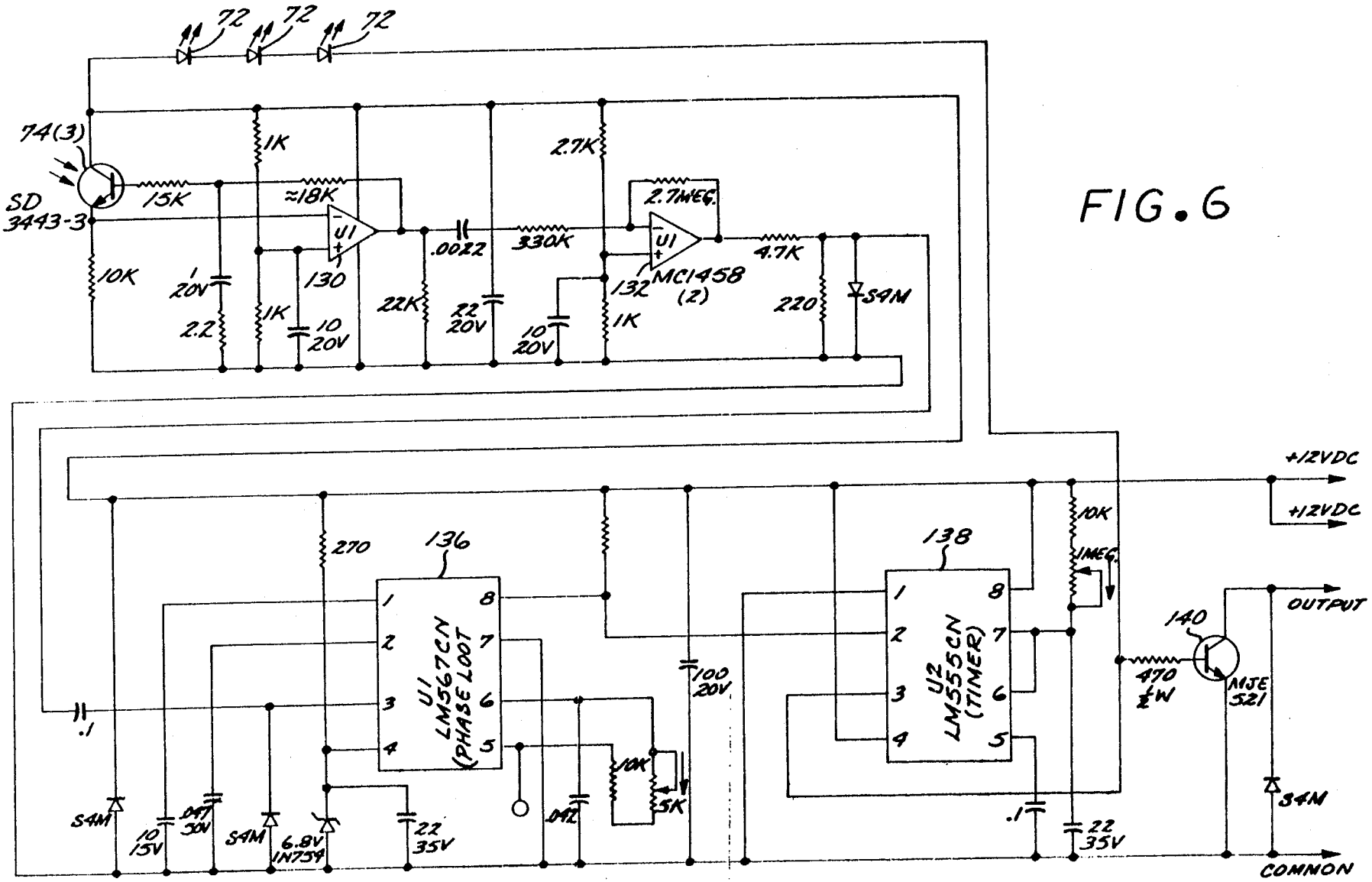
FIG. 6 is an electrical schematic diagram of the receiver of the invention.

FIG. 6 is an electrical schematic diagram of the receiver circuitry. In particular, the receiver circuitry includes one infrared detector 74, the output of which is connected to a signal processing circuit including operational amplifiers 130 and 132 and their associated biasing resistors and capacitors. The output of the signal processing amplifier is connected as input to a conventional phase-locked loop 136 with its associated external circuitry chosen so that the phase-locked loop responds to pulses at 1800 Hz. The output of the phase-locked loop is connected as an input to a conventional timer 138 having its associated external circuitry set for a 1-2 second time period. The output of the timer is then connected to three light emitting diodes 72. It should be appreciated that when the timer is triggered, the output line goes to a logical "1" which removes the power from the light-emitting diodes 72, thereby turning them off. The output of the timer 138 is also connected as an input to a transistor 140, the output of which can be used to generate a scoring signal on auxiliary equipment (not shown).

Thus, the optical communications system of the present invention affords general advantages in the character of the infrared signal emitted from the transmitter and affords particular advantages in the illustrated application of a transmitter and receiver in the form of a firearm replica and a target for a shooting gallery for amusement parks. While a particular presently preferred embodiment of the invention has been described in detail, it should be appreciated that there may be other applications for the system of the invention. Therefore, the scope of the invention is not to be limited, except by the following claims.

I claim:

1. An optoelectronic communications system, comprising:

transmitter means for transmitting energy substantially in the optical spectrum range, said transmitting means including:

transducer means for converting electrical input energy to energy in said optical spectrum, pulse generator means for generating electrical power pulses at a predetermined pulse rate and connected as input energy to said transducer means, said pulse generator means including a monostable multivibrator triggered by an oscillator;

pulse train duration control means connected to said pulse generator means for operating said pulse generator means only for a predetermined time duration, said pulse train duration control means including a resistor-capacitor timing circuit with its output connected to the inputs of a NOR gate, the output of the NOR gate being connected to said pulse generator means whereby the charging of said capacitor to a predetermined voltage causes said NOR gate to change state;

receiver means for receiving energy substantially in said optical spectrum range, said receiver means including, detecting means for detecting energy in said spectrum and generating an electrical signal in response thereto, pulse rate detection means responsive to said electrical signal occurring at a predetermined rate, said rate detection means generating a control signal in response thereto, said detecting means including a phase locked loop circuit driven by said electrical signal, and display means for generating a visible display from said receiver means, said display means being responsive to said control signal to extinguish said visible display for a predetermined time period.

2. The optoelectronic communications system as defined in claim 1, including:

trigger means for initiating said pulse train duration control means in response to an externally controlled trigger signal, said trigger means connecting a source of voltage to said resistor-capacitor timing circuit.

3. An optoelectronic communications system for use in an amusement park shooting gallery, comprising:

transmitter means for emitting infrared energy, said transmitter means being mounted in a firearm replica, said transmitter means including:

transducer means for converting electrical input energy to infrared energy, said transducer means being mounted in said replica to emit said infrared energy along a barrel of said replica, lens means mounted in said barrel to focus said infrared energy into a narrow beam which eminates from said barrel, pulse generating means for generating electrical input energy at a predetermined pulse rate to said transducer means, said pulse generating means being selectively enabled by a manual trigger signal, said pulse generator means including a monostable multivibrator triggered by an oscillator;

pulse train duration means connected to said pulse generating means for enabling said pulse generating means for a predetermined pulse train duration in response to said manual trigger signal, said pulse train duration control means including a resistor-capacitor timing circuit with its output connected to the inputs of a NOR gate, the output of the NOR gate being connected to said pulse generator means whereby the charging of said capacitor to a predetermined voltage causes said NOR gate to change state;

receiver means for receiving said infrared energy from said transmitter means, said receiver means being configured as a target for said fireman replica, said receiver means including:

detecting means for detecting infrared energy and generating a detection signal in response thereto;

pulse rate detection means for responding to said detection signal occurring at said predetermined pulse rate, said pulse rate detection means generating a control signal in response to said detection signal, said pulse rate detection means including a phase locked loop circuit driven by said detection signal; and display means for generating a visible display from said receiver means, said display means being responsive to said control signal to extinguish said visible display for a predetermined time period.

4. The optoelectronic communications system as defined in claim 3 wherein said receiver means includes:

a translucent display panel serving as said target for said firearm replica, said translucent display panel having mounted behind it said detecting means and said display means.

5. The optoelectronic communications system as defined in claim 4, wherein:

said display means includes at least one light-emitting diode for generating said visible display and said detecting means includes at least one infrared sensitive photo-detector.

6. An optoelectronic transmitter means for use in an amusement park shooting gallery, said transmitter means emitting infrared energy and being mounted in a firearm replica, said transmitter means including:

transducer means for converting electrical input energy into infrared energy, said transducer means being mounted in said replica to emit said infrared energy along a barrel of said replica;

lens means mounted in said barrel for focusing said infrared energy into a narrow beam which emanates from said barrel; and pulse generating means for generating electrical input energy at a predetermined pulse rate to said transducer means, said pulse generating means being selectively enabled by a manual trigger signal, said pulse generating means including a monostable multivibrator triggered by an oscillator; and pulse train duration means connected to said pulse generating means for enabling said pulse generating means for a predetermined pulse train duration in response to said manual trigger signal, said pulse train duration control means including a resistor-capacitor timing circuit with its output connected to the inputs of a NOR gate, the output of the NOR gate being connected to said pulse generator means whereby the charging of said capacitor to a predetermined voltage causes said NOR gate to change state.

* * * * *